United States Patent [19]

Kerscher

[11] 4,316,672

[45] Feb. 23, 1982

[54] SHAKING MACHINE, ESPECIALLY FOR INDIAN INK WRITING DEVICE

[76] Inventor: Wolfgang Kerscher, Moosweg 8, 8400 Regensburg, Fed. Rep. of Germany

[21] Appl. No.: 42,047

[22] Filed: May 24, 1979

[30] Foreign Application Priority Data

Jun. 7, 1978 [DE] Fed. Rep. of Germany ... 7817065[U]

[51] Int. Cl.[3] ..... B01F 11/00

[52] U.S. Cl. ..... 366/212; 366/110; 366/240

[58] Field of Search ..... 366/110, 108, 111, 113, 366/114, 128, 212, 240

[56] References Cited

U.S. PATENT DOCUMENTS

| | | | |
|---|---|---|---|
| 1,527,227 | 2/1925 | Sanders | 366/212 |
| 2,846,201 | 8/1958 | Mermelstein | 366/110 |
| 3,128,082 | 4/1964 | Cline | 366/110 |
| 3,660,860 | 5/1972 | Dziuk | 366/127 |
| 4,085,955 | 4/1978 | Salle | 366/212 |

FOREIGN PATENT DOCUMENTS

| | | |
|---|---|---|
| 684615 | 12/1952 | United Kingdom . |
| 1330975 | 9/1973 | United Kingdom . |

*Primary Examiner*—Robert W. Jenkins

*Attorney, Agent, or Firm*—Eyre, Mann, Lucas & Just

[57] ABSTRACT

The invention refers to a vibration or shaking machine, especially for Indian ink writing devices, said machine having a housing with a guide in which is guided a sliding holder for holding at least one of the objects to be shaken, as well as a driving motor for the holder in the housing.

4 Claims, 3 Drawing Figures

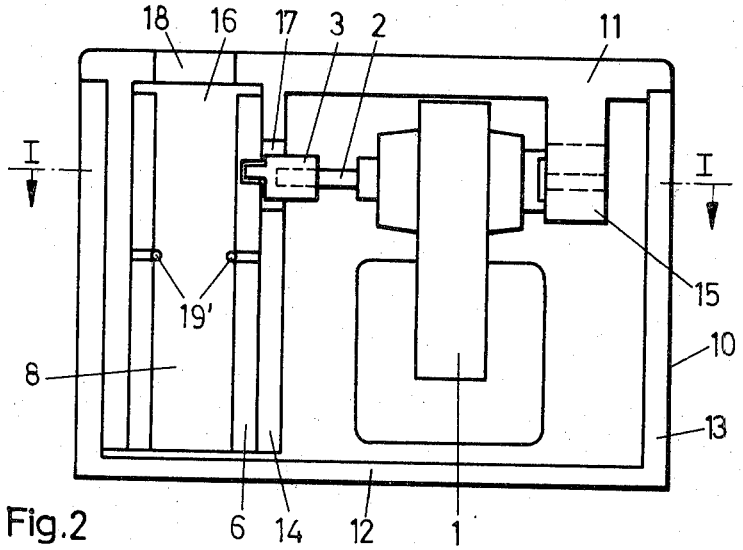
Fig.2
Fig.3
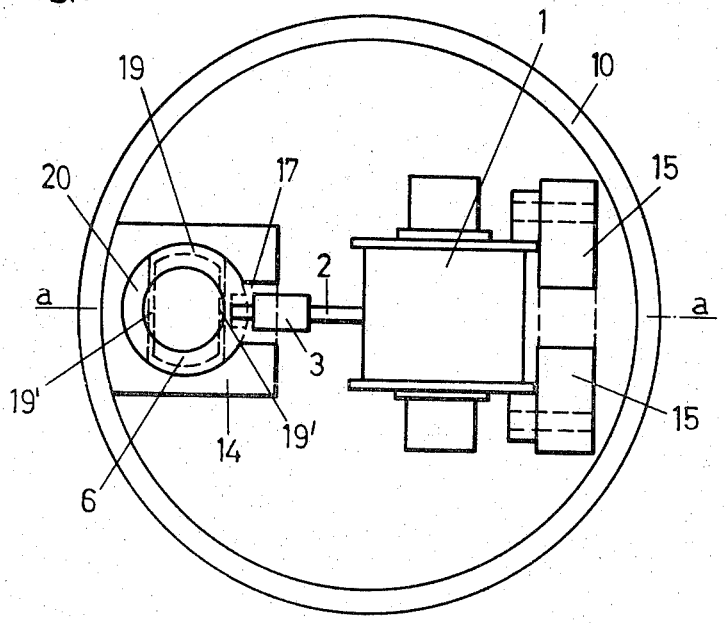

SHAKING MACHINE, ESPECIALLY FOR INDIAN INK WRITING DEVICE

In writing devices using Indian ink there exists the problem that when a writing device using Indian ink, which is no longer needed, is placed aside, then the Indian ink will dry out within a short time in the narrow channels of this writing device which connect the storage chamber for the Indian ink to the writing end of the device, so that the normal Indian ink flow is interrupted. The dried out Indian ink can be removed only by vigorous shaking of the Indian ink writing device in question, which is inconvenient and time consuming. Also in other fields, for example, in chemical laboratories a general need exists to expose objects, for example reagent tubes, to shaking movement.

The objective of the present innovation is to provide a shaking machine, by means of which simple and convenient shaking of objects is ensured and which can be produced at low costs. For the solution of this problem a shaking machine, especially for Indian ink writing devices according to the invention is characterised by a housing with a guide, in which a holder is used for holding at least one of the objects to be shaken, as well as by a drive motor for the holder in the housing.

The shaking machine according to the innovation can be made with relatively small dimensions as a desk top instrument. This arrangement ensures highly effective shaking of objects. Hence, for example, the shaking machine according to the innovation will ensure that treatment lasting only 5 seconds will make a lightly dried Indian ink writing device once again fully operational.

An electric motor, for example an electric motor with 3000 rev./min, is used as the drive motor. The drive motor is connected with this holder, for example, by means of an eccentric, which engages with a carrier opening of the holder. However, other methods of the driving coupling between the drive motor and holder are possible.

The innovation is described below by means of the Figures and an embodiment example in detail in which:

FIG. 2 is a cross section through a possible practical embodiment of the shaking machine according to FIG. 1;

FIG. 3 is a cross section along the line I—I of FIG. 2

Figure 1:
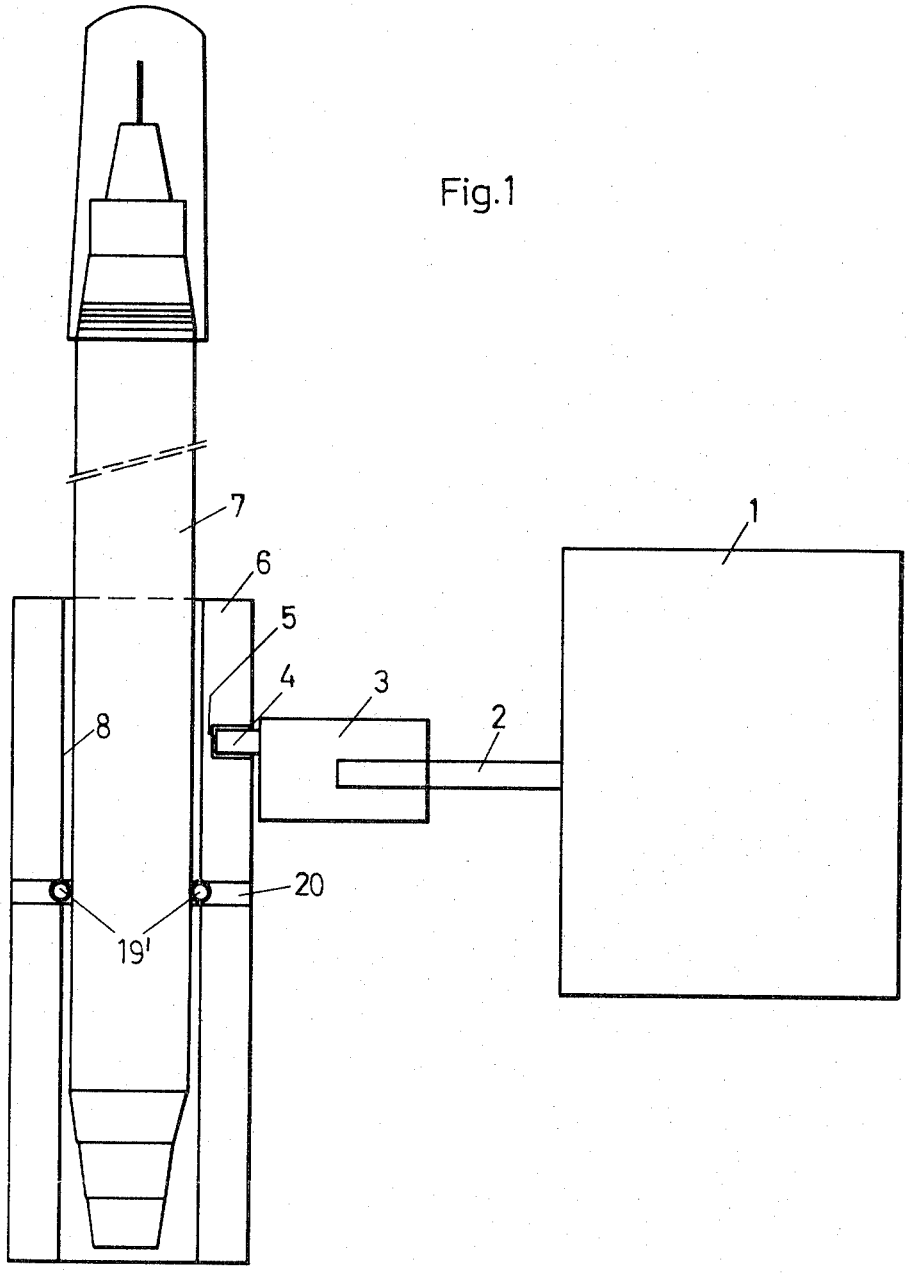
FIG. 1 is a diagram of a shaking machine with an embodiment form of the innovation, with an Indian ink writing device inserted into the holder

The shaking machine shown in the Figures consists of a drive motor or electric motor 1, on whose shaft 2 is fastened a sleeve or a cylinder 3 in such a manner that the shaft 2 with its free end will project into the inner bore of this cylinder 3 and it is anchored there in a suitable manner. On the end face facing away from the electric motor 1 the cylinder piece has a pin 4, which is arranged eccentrically relative to the axis of the shaft 2 and which engages with a carrier slot 5 of a holder 6 for an Indian ink writing device 7. The holder 6 is a sleeve shaped element and has an internal bore 8, into which the Indian ink writing device 7 reaches to a certain extent on operation of the shaking machine (FIG. 1).

The electric motor 1, the holder 6 as well as the elements which connect the electric motor with this holder for driving purposes are accommodated in a housing 9, which is circular in the embodiment forms shown in FIGS. 2 and 3 in special form and which consists of a cup or beaker shaped housing part 10 and of a cover part 11. The housing part 10 has a closed bottom 12 and a circular circumferential wall 13 arranged at right angles to the bottom 12; this circumferential wall is made integrally with the bottom 12.

The circular cover 11, which is fastened with suitable means not described in greater detail, for example on the wall 13, has at its inner face a guide 14 for the holding arrangement 6 as well as lugs 15 for fastening the electric motor 1. The guide 14 and the lugs 15 in this case are made preferably integrally with the cover part 11.

The guide 14, which is formed by a projection which projects at right angles to the inner face of the cover part 11 and which reaches up to the direct vicinity of the bottom 12, has an internal bore 16, which has a cross section matching the outside circumference of the holder 6 and whose axis is also at right angles to the surface sides of the cover part 11. At the end adjacent to the cover part 11 there is provided in the guide 14 a continuous through opening 17, through which the cylinder 3 projects with its pin 4, which latter, as already described above, engages with the carrier slot 5, which latter projects at right angles to the axis of the inner bore 16 of the guide 14. On driving the shaft 2 by the electric motor 1 the holder 6 is moved by means of the pin 4 which acts as eccentric in the guide 14 or in the inner bore 16 of this guide upwards and downwards. For this purpose the length of the holder 6 is selected so that in the upper position of this holder there remains still a sufficient distance to the cover part 11 and in the lower position of the holder there is still a sufficient distance to the bottom 12.

For inserting the Indian ink writing device 7 into the holder 6 the cover 11 has an opening 18 whose diameter matches the inner bore 8 of the holder 6 or which is slightly greater than the diameter of the inner bore 8 and which covers exactly this inner bore 8.

In order to ensure that the Indian ink writing device 7 inserted into the holder will fully follow the movement of the holder 6 when the electric motor is connected, there are provided in the holder 6 means with which the Indian ink writing device is clamped firmly. These means consist in the simplest case of a ring 19 of rubber or of some other elastic material, which is arranged in a circumferential groove 20 of the holder 6. The depth and the design of the groove 20 are arranged in such a manner that the ring 19 over the whole circumference of the holder 6 will not project beyond the circumferential surface of this holder, whereby on two opposite facing positions, i.e. on the circumference of the holder the groove 20 is continuous at the positions arranged at 180° opposite each other, so that the ring 19 will project there with a section 19' into the inner bore 8 of the holder 6 and it rests against the outside surface of the Indian ink writing device 7 inserted into the holder 6. Hence the Indian ink writing device 7 is clamped into the holder 6.

The housing 9, i.e. the housing part 10 and the cover 11 are made preferably from plastics material. In addition also the holder 6 and/or the cylinder piece 3 including the pin 4 are made preferably from plastics material. For the switching on of the electric motor 1 a depression switch can be provided on the cover 11. It is of course also possible to control the electric motor by means of another switch, or however, with the assistance of a time switch (switching clock).

The innovation was described above by means of an embodiment example. It is understood that variants of this are possible without departure from the inventive idea on which the innovation is based.

I claim:

1. A shaking machine comprising:

(a) a housing;

(b) a guide bore inside said housing;

(c) a holder formed by a sleeve-shaped body;

(d) said holder being adapted for holding at least one Indian ink writing device;

(e) said holder being slidably guided in said guide bore for reciprocating movement therein parallel to the axis of said guide bore;

(f) means for reciprocating said holder in said guide bore;

(g) means for clamping said at least one Indian ink writing device in said holder, wherein said means for clamping comprises an elastic ring held in a circumferential groove of said holder, at least a portion of said elastic ring extending into the inner bore of the sleeve-shaped holder through at least one slot along said circumferential groove.

2. A shaking machine according to claim 1 wherein said means for reciprocating comprises a shaft driven by a driving motor, said shaft having an eccentric engaging a driving opening of said holder.

3. A shaking machine according to claim 1 wherein said housing comprises a cup-shaped housing part and a cover, said driving motor and said guide bore being included on said cover.

4. A shaking machine according to claim 3 wherein said guide bore is formed in a projection of said cover, said projection projecting from the inner surface of said cover into the interior of said housing.

* * * * *